United States Patent [19]

Blanchard et al.

[11] Patent Number: 4,467,569

[45] Date of Patent: Aug. 28, 1984

[54] TELESCOPIC RISERS

[75] Inventors: Russell O. Blanchard; Douglas F. Wolff, both of Marshall; Charles E. Steele, Pennfield Township, Calhoun County, all of Mich.; Richard P. Molloy, deceased, late of Portage, Mich., by Vera C. Molloy, heir and legal representative

[73] Assignee: Interkal, Inc., Kalamazoo, Mich.

[21] Appl. No.: 374,112

[22] Filed: May 3, 1982

[51] Int. Cl.[3] ..... E04H 3/12

[52] U.S. Cl. ..... 52/9; 52/183; 297/15

[58] Field of Search ..... 52/9, 36, 183, 6, 8, 52/22, 7, 29, 10; 297/15

[56] References Cited

U.S. PATENT DOCUMENTS

| | | | |
|---|---|---|---|
| Re. 29,635 | 5/1978 | McClelland et al. | 52/9 |
| 1,147,779 | 7/1915 | Beemer | 52/173 |
| 2,740,165 | 4/1956 | Ward | 52/183 |
| 2,817,122 | 12/1957 | Walworth | 20/1.126 |
| 2,987,111 | 6/1961 | Walworth | 155/130 |
| 2,990,587 | 7/1961 | Murphy | 20/1.126 |
| 3,025,106 | 3/1962 | Evans et al. | 297/248 |
| 3,107,399 | 10/1963 | Murphy | 52/10 |
| 3,279,131 | 10/1966 | Curra, Jr. | 52/9 |
| 3,282,363 | 11/1966 | Curra, Jr. | 180/9.22 |
| 3,400,502 | 9/1968 | Scaggs et al. | 52/9 |
| 3,488,898 | 1/1970 | Scaggs | 52/10 |
| 3,747,706 | 7/1973 | Paine et al. | 16/126 |
| 3,788,608 | 1/1974 | Raymond et al. | 52/9 |
| 3,968,606 | 7/1976 | Facemire | 52/6 |
| 4,155,202 | 5/1979 | Hartman | 52/9 |

FOREIGN PATENT DOCUMENTS

| | | | |
|---|---|---|---|
| 2543176 | 4/1977 | Fed. Rep. of Germany | 52/7 |
| 2927748 | 1/1981 | Fed. Rep. of Germany | 52/9 |
| 1215780 | 4/1960 | France | 52/6 |
| 2384920 | 11/1978 | France | 52/9 |
| 0380932 | 10/1964 | Sweden | 52/10 |
| 0657978 | 10/1951 | United Kingdom | 52/6 |
| 0872710 | 10/1981 | U.S.S.R. | 52/6 |

OTHER PUBLICATIONS

BBB Publication of Inbau AG, and Translation.

*Primary Examiner*—Henry E. Raduazo
*Attorney, Agent, or Firm*—Flynn, Thiel, Boutell & Tanis

[57] ABSTRACT

A telescopic multi-tier riser assembly formed from a plurality of telescopic multi-tier riser modules positioned in side-by-side relationship. Each said riser module is of a telescopic multi-tier construction and includes top and bottom platforms and at least one intermediate platform. The platforms are telescopically movable relative to one another between an open position wherein the individual platforms project forwardly in a step-like manner and a closed position wherein the platforms are vertically supported one above the other. The platforms each have a side-to-side width which is substantially less than its front-to-back length, which width comfortably accommodates only a single chair on the respective platform. A modesty panel assembly is preferably hingedly supported on each platform adjacent the forward edge thereof and swingably movable relative to the respective platform between an upright use position and a horizontal storage position wherein the modesty panel assembly is supported on the upper surface of the respective platform.

21 Claims, 13 Drawing Figures

TELESCOPIC RISERS

FIELD OF THE INVENTION

This invention relates to an improved riser assembly formed from a plurality of telescoping multi-tier riser modules which are positionable in side-by-side relationship, the individual riser modules being effectively of a single chair width.

BACKGROUND OF THE INVENTION

Telescopic multi-tier riser assemblies are well known and are extensively utilized to provide a tiered seating arrangement for large groups of people. These known assemblies often incorporate fixed or collapsible seats thereon. However, the known structures are generally of extremely large size in that each tier is normally of great width so as to accommodate thereon a large number of chairs or seats disposed within a single row. Because of this size, these known riser assemblies are extremely difficult to move about and, for all practical purposes, are effectively dedicated for use in a predetermined location after their initial installation. Further, with these known assemblies, the individual risers or platforms are normally each provided with their own system of depending legs and support frames which individually rollingly engage and support the riser on the floor, which thus further complicates the overall structure of the assembly. Still further, the known assemblies which have incorporated collapsible seating and the like have normally done so only at the expense of requiring substantially increased vertical spacing between the adjacent tiers or platforms, and hence often resulting in excessive and undesired height in the completed assembly.

The present invention thus relates to an improved telescopic multi-tier riser or platform assembly which possesses numerous structural and operational advantages in comparison to known assemblies as briefly described above. More specifically, the improved riser assembly of this invention is formed by a plurality of individual modules which are positioned in side-by-side relationship, which modules can be easily locked together. Each module itself comprises a telescopic multi-tier arrangement, which module is sized such that each tier comfortably accommodates only a single chair thereon. Further, the tiers closely telescope one over the other when closed so that a maximum number of tiers can be provided with minimum height. The complete module, when in a closed position, can be easily manually rolled about, under the control of the single individual, so as to greatly facilitate the use of the riser module and its movement from room to room as desired. In particular, each riser module is narrow, and has a horizontal width which is less than its length, so as to permit the module to be easily rollingly moved through conventional-width doorways, and also enabling the module to be moved onto and off of conventional small passenger elevators so as to permit it to be readily moved between floors. With this arrangement, the riser assembly is portable and is hence particularly desirable for use in environments where maximum mobility and versatility is required, such as in hotels, motels and the like, since the improved riser assembly of this invention can be easily opened or closed, and the individual modules can be readily moved from room to room or from floor to floor if desired.

In the improved riser assembly of this invention, the individual risers or platforms of each module are preferably rollingly supported directly one upon the other so as to thereby simplify the overall structure, and at the same time provide for proper rolling alignment of the telescopic risers during the opening and closing of the module.

Further, with the improved riser assembly of this invention, the individual risers are each provided with a collapsible work surface-modesty panel assembly which is suitably interconnected to the respective riser so as to be easily moved between an upright position and a closed storage position wherein it lies on the upper surface of the riser so as to permit telescopic closing of the module. These work surface-modesty panel assemblies, if desired, can be easily removed in their entirety from the respective risers so that a selected module can thus function as an aisle. The removal of the modesty panel assemblies is such that there are no resulting projections or protuberances which would interfere with the use of the selected module as an aisle.

Still further, the structure of this improved riser assembly is such that the individual risers of each module are constructed such that each is defined by a surrounding rectangular frame, the side rails of which function as guides for flanged rollers associated with the forward end of the next uppermost riser, which frame in turn supports a recessed central platform which enables carpeting or the like to be supported thereon in substantially flush relationship with the upper surface of the frame so that the resulting riser assembly is more comfortable in use and more desirable in appearance.

In addition, with this improved riser assembly, any selected number of modules can be positioned in side-by-side relationship so as to provide a system having any desired number of seats, whereby the size of the assembly can hence be easily decreased or increased in accordance with the size of the room being utilized, and particularly in accordance with the number of seats desired, this being particularly desirable in situations where rooms are being utilized for seminars, business meetings and the like. Further, by suitably positioning the riser section which functions as the aisle, or by removal of the modesty panel assemblies if necessary, the resulting riser assembly can be provided with one or more aisles at whatever location desired. Also, all of the riser modules are provided with suitable sockets therein so as to accommodate removable side rail assemblies along the open sides of the end modules, thereby providing the overall assembly with optimum flexibility and adaptability.

Other objects and purposes of the invention will be apparent to persons familiar with structures of this type upon reading the following specification and inspecting the accompanying drawings.

Figure 1:
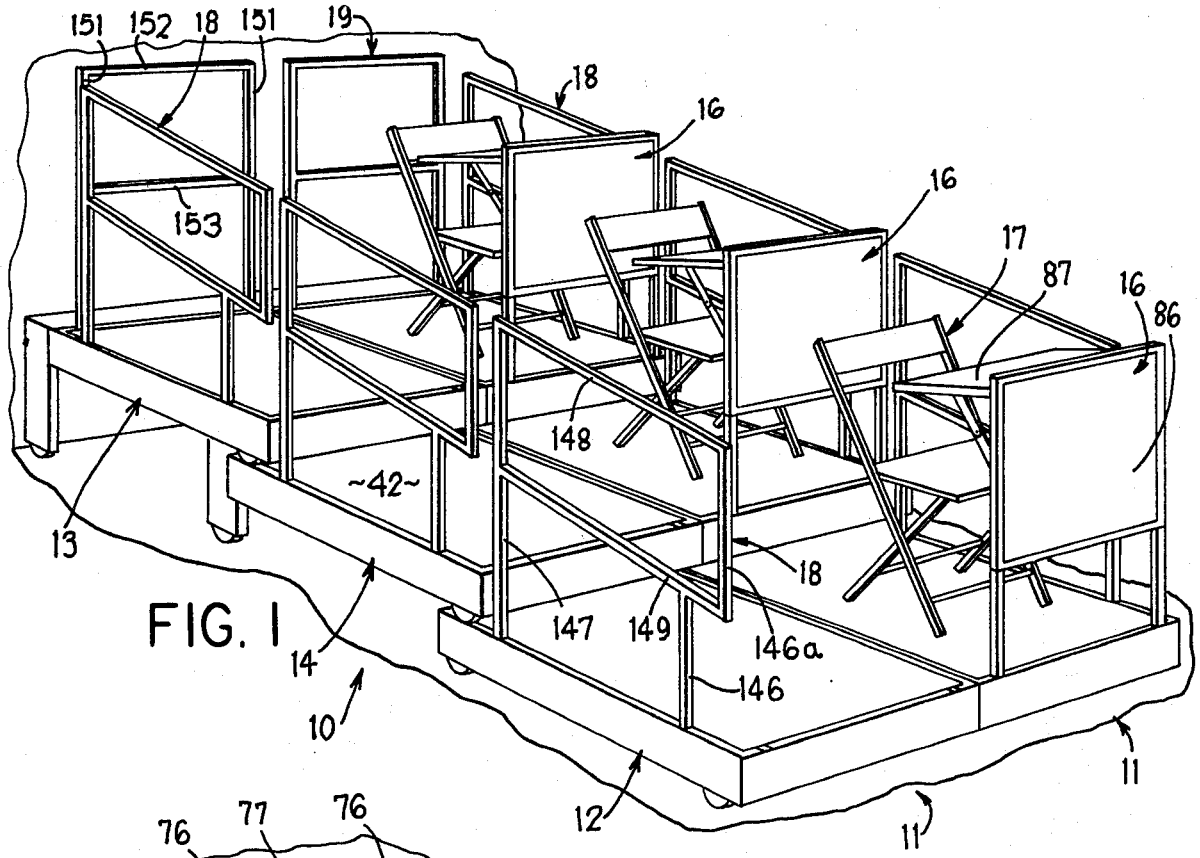
FIG. 1 is a perspective view illustrating the improved riser unit of this invention, which unit as illustrated incorporates two modules each possessing three risers.

Certain terminology will be used in the following description for convenience in reference only, and will not be limiting. For example, the words "upwardly", "downwardly", "leftwardly" and "rightwardly" will refer to directions in the drawings to which reference is made. The words "right" and "left" will also refer to the opposite sides of the respective tiers when viewed by a person sitting on the tier and facing forwardly. The word "front" will refer to the end of the module having the lowermost tier, and the word "rear" will refer to the opposite end of the module. The words "inwardly" and "outwardly" will refer to directions toward and away from, respectively, the geometric center of the module or designated parts thereof. Said terminology will include the words specifically mentioned, derivatives thereof, and words of similar import.

DETAILED DESCRIPTION

Referring to FIG. 1, there is illustrated a riser or platform assembly 10 which incorporates therein the improvements of the present invention. This assembly 10 is formed from two substantially identical riser modules or sections 11 which are positioned in side-by-side relationship, each module 11 being of a telescoping multi-tier construction. The assembly 10 of FIG. 1 illustrates only two side-by-side modules 11 solely for convenience in illustration, but it will be appreciated that any desired number of modules 11 can be disposed side by side depending upon the desired size of the assembly.

The riser module 11 of the present invention, as illustrated by FIGS. 1–4, incorporates three tiers or platforms, namely a front or lower tier 12, a rear or upper tier 13, and an intermediate tier 14. The riser module 11 is illustrated as incorporating three tiers solely for convenience in illustration, although it will be appreciated that the module normally incorporates a larger number of tiers (such as five), this being accomplished by increasing the number of intermediate tiers 14, which additional intermediate tiers coact in the same manner so that additional illustration and description relative to same is believed unnecessary.

Figure 6:
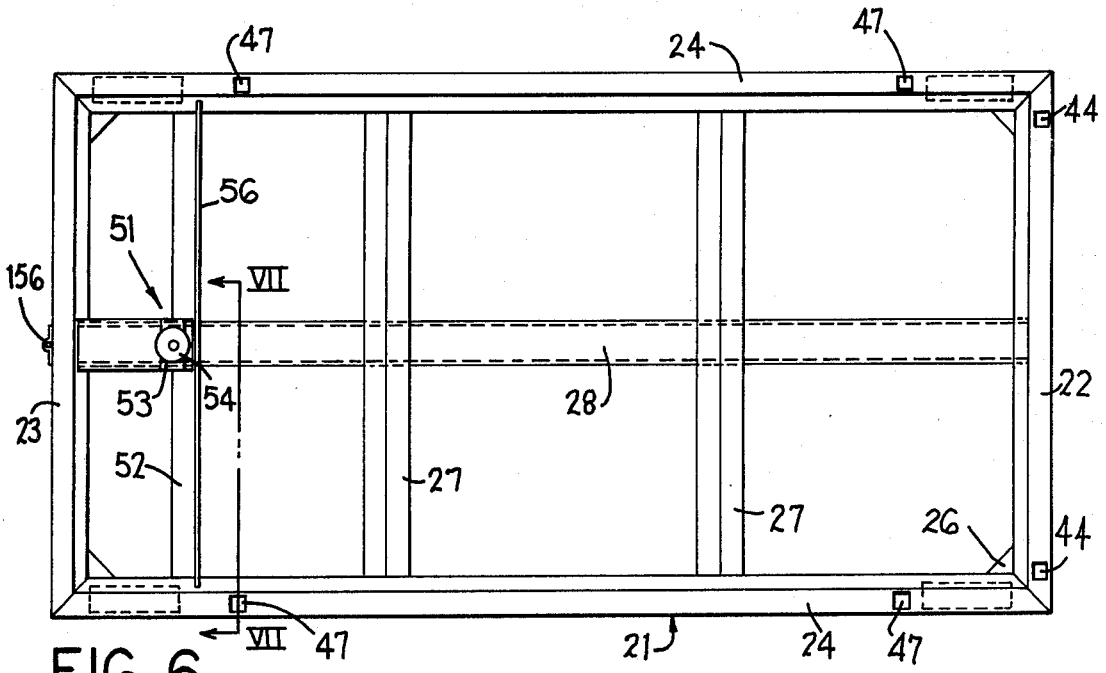
FIG. 6 is a top view of the tier shown in FIG. 5 except that the floor has been removed for purposes of illustration.
Figure 5:
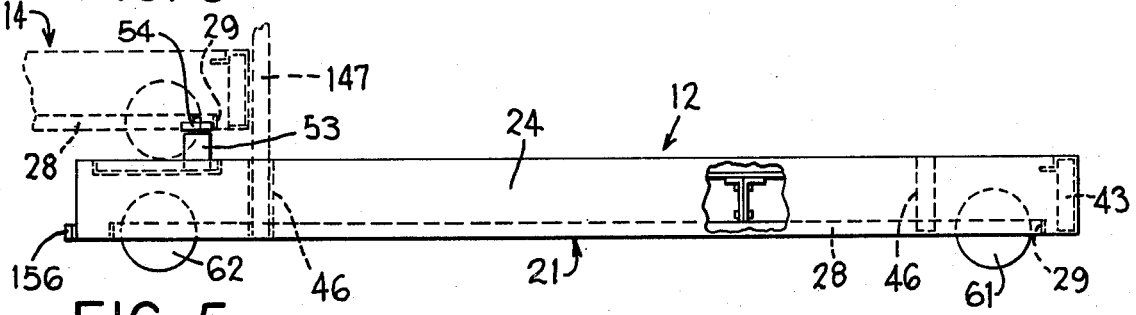
FIG. 5 is a side view of the lowermost riser or platform.

Considering the lower or front tier 12, and referring to FIGS. 5 and 6, same includes a rectangular frame 21 formed by parallel front and rear frame members 22 and 23, respectively, the latter being rigidly joined together by parallel side frame members 24. All of these frame members, in the illustrated embodiment, comprise elongated channel-like steel rails suitably fixedly joined, such as by welding. The frame preferably incorporates corner gussets 26 for rigidification, and also includes a plurality of transverse stiffeners 27 which rigidly join the side rails 24. A guide rail 28 is positioned midway between the side rails 24 and extends parallel thereto, with the opposite ends of this guide rail 28 being fixedly secured to the front and rear rails 22-23. This guide rail 28 is disposed substantially flush with the lower side of the frame and defines therein an elongated channel which opens downwardly. The forward end of this guide channel 28 defines thereon a transversely extending stop flange 29.

Figure 8:
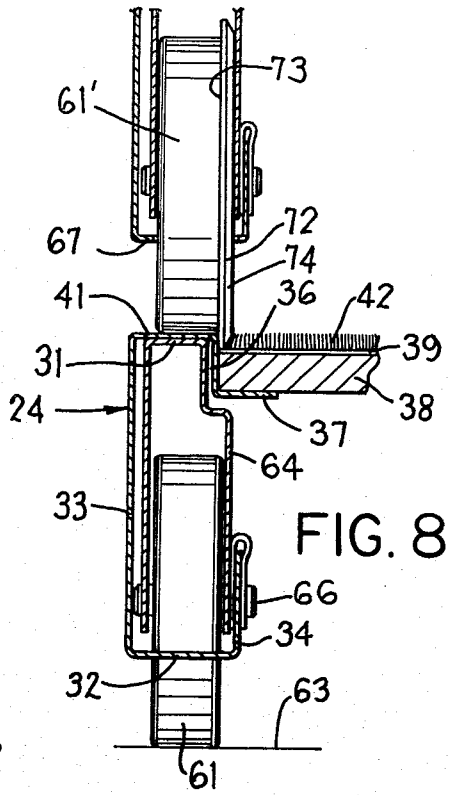
FIG. 8 is an enlarged, fragmentary sectional view taken substantially along the line VIII—VIII in FIG. 4.

Each of the rails 22–24 is identical in cross section, and FIG. 8 illustrates this cross section relative to the side rail 24. Each frame rail is formed by an elongated hollow member of generally channel shape, and includes substantially parallel top and bottom walls 31 and 32, respectively, the latter being rigidly and integrally joined by an outer vertical side wall 33. A lower side flange 34 is joined to the inner edge of the bottom wall 32 and projects upwardly therefrom in parallel relationship to the side wall 33, this side flange 34 projecting only partway so as to terminate in an upper free edge. A further or upper side flange 36 projects downwardly from the inner edge of the top wall 31 in substantially parallel relationship to the side wall 33. This upper side flange 36 projects downwardly through only a relatively small distance, such as approximately one inch, and then is bent inwardly so as to form a narrow horizontal support flange 37. These latter support flanges 37, as defined by the frame rails, in turn support thereon a floor panel 38 (such as a sheet of plywood), which floor panel 38 extends between the opposed side rails so as to define the upper support floor for the tier. This floor panel 38 has the horizontal upper surface 39 thereof disposed at a slight elevation below the upper surface 41 defined on the frame rails. A suitable pad 42, specifically a rectangular piece of conventional carpet, wholly overlies the floor panel 38 and is suitably secured thereto, as by an adhesive. The carpet 42 has a thickness which is selected so that the upper surface of the carpet is approximately coplanar with the upper rail surfaces 41.

The front rail 22 of the frame has a pair of vertical socket tubes 43 (FIG. 11) fixed thereto. These socket tubes, which are disposed adjacent the opposite ends of the front rail, are disposed so that the tube is positioned directly adjacent the inside surface of the side wall of the front rail, with the lower end of the tube 43 being suitably closed by the bottom wall of the rail, whereas the upper end of the tube 43 defines an opening 44 through the top wall of the rail.

Each of the side rails 24 also has a pair of socket tubes 46 (FIGS. 5–7) fixed thereto and disposed within the respective side rail, which socket tubes 46 again are closed at their lower ends by the bottom wall of the rail but open upwardly through an opening 47 formed in the top wall of the side rail. These socket tubes 46 are positioned adjacent the opposite ends of the respective side rail.

Figure 7:
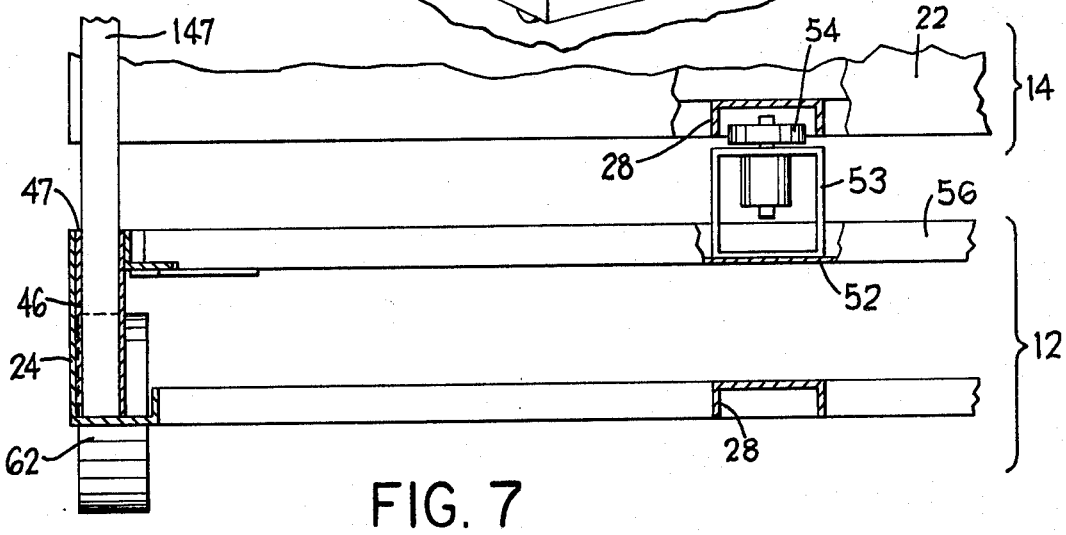
FIG. 7 is an enlarged, fragmentary sectional view taken substantially along line VII—VII in FIG. 6, and additionally illustrating the cooperation between the lower and intermediate tiers.

The frame 21 of the lower or front tier 12 also mounts thereon a guide means 51 which slidably guidably cooperates with the next uppermost tier 14. This guide means 51, as illustrated by FIGS. 5–7, is provided by means of a transverse support angle 52 which is fixed to and extends perpendicularly between the side rails at a location parallel to but spaced slightly forwardly from the rear rail 23. This support angle 52 has an upwardly projecting bracket 53 mounted thereon at a location positioned substantially directly over the guide channel 28. This bracket 53 in turn mounts thereon a rotatable guide roller 54, the latter being disposed for rotation about a substantially vertical axis. This roller 54 is elevationally positioned such that it projects into the downwardly opening guide channel 28 of the next uppermost tier 14, as illustrated by FIG. 7.

This support angle 52 also has an upwardly projecting flange 56 which defines a rear abutment for the floor panel 38. This latter panel need not project rearwardly beyond the flange 56 on either the front or intermediate tiers inasmuch as the portions of the tiers located behind this flange 56 are always overlapped by the next uppermost tier.

The frame 21 of the front tier 12 mounts thereon a pair of front rollers 61 and a pair of rear rollers 62, which rollers are mounted on the side rails 24 adjacent the opposite ends thereof. These rollers 61 and 62 on the front tier 12 are identical and are of generally cylindrical construction so as to be rollingly supported on a horizontally planar support surface such as a floor 63.

Each of these rollers 61–62 is, as illustrated by FIG. 8, supported on the respective side rail 24 by means of a suitable yoke or channel 64 which is fixed to and positioned within the side rail, which yoke 64 appropriately straddles the roller and suitably rotatably supports same by means of an appropriate axle 66 which extends through the roller and is supported on the yoke and on the adjacent side flange 34 of the rail. The rollers 61–62 are, for the most part, confined within the interior of the side rail except that the lower portion of each roller 61–62 projects downwardly through an appropriate clearance slot 67 as formed in the bottom wall of the side rail.

Considering now the intermediate tier 14, this tier 14 is identical to the above-described front tier 12 except for differences in the roller arrangement. More specifically, the front rollers 61' on the intermediate tier 14 are substantially identical to the rollers 61 except that rollers 61' are additionally provided with a radially enlarged annular flange or rim 72 (FIG. 8) on the axially inner side thereof. This rim 72 is designed so as to project downwardly past the inner side flange 36 of the side rail of the next lower tier so that the upper tier is hence properly guided when rollingly displaced relative to the lower tier. This guide flange 72 on the roller 61 defines thereon a substantially planar shoulder 73 which effectively abuts the exposed side surface of the side flange 36. Further, this side flange 72 has the outer surface 74 thereof defined substantially as a truncated tapered surface since this hence effectively facilitates the penetration of the flange 72 into the edge of the carpeting 42. If necessary, the edge of the carpeting 42 can be maintained slightly spaced from the side rail flange 36, and of course the compressibility and deformability of the carpet 42 will also permit it to accommodate the roller flange 72. These front rollers 61' are otherwise supported on the side rails of the intermediate tier in the same manner as described above relative to the front tier.

The rear rollers on the intermediate tier 14 are supported in a somewhat different manner. More specifically, the intermediate tier 14 has a pair of vertically elongated legs 71 positioned adjacent and fixed to the rear frame rail 23. These legs 71 project rearwardly from the rear frame rail and project downwardly toward the floor, which rear legs 71 hence support thereon rollers 62 which are conventional cylindrical rollers disposed for direct rolling engagement with the floor. The support legs 71 are disposed adjacent but spaced slightly inwardly from the opposite ends of the rear frame rail so that the legs of the intermediate tiers can nest one within the other and can in turn nest within the legs of the top or rear tier when the riser module is telescopically closed.

The rollers 61, 61', 62 are preferably molded of a plastics material such as polyurethane.

The top or rear tier 13 is structurally identical to the intermediate tier 14 as just described, except that the rear legs 71' of the rear tier are positioned such that they are aligned and substantially flush with the frame side rails. Further, this rear tier 13 is not provided with guide means 51 thereon since there is no additional tier positioned thereabove. Hence, not only is the guide means 51 eliminated, but also the floor panel 38 extends all the way to the support flange provided on the rear frame rail. In addition, a rear cover panel 77 is normally supported on and extends between the upper ends of the rear legs 71' so as to effectively enclose the region therebetween. This rear cover panel 71 effectively constitutes an extension of the rear tier, although this rear panel is normally removable so as to provide access to the region therebelow. This rear or top tier 13 is additionally provided with a pair of socket tubes 76 fixed within and opening upwardly through the rear frame rail adjacent the opposite ends thereof, which socket tubes 76 are substantially identical to the side socket tubes 46 so that further description thereof is believed unnecessary.

Each tier is also preferably provided with a collapsible work surface-modesty panel assembly 16, which assembly is described hereinafter and is referred to solely as the panel assembly 16.

Figure 9:
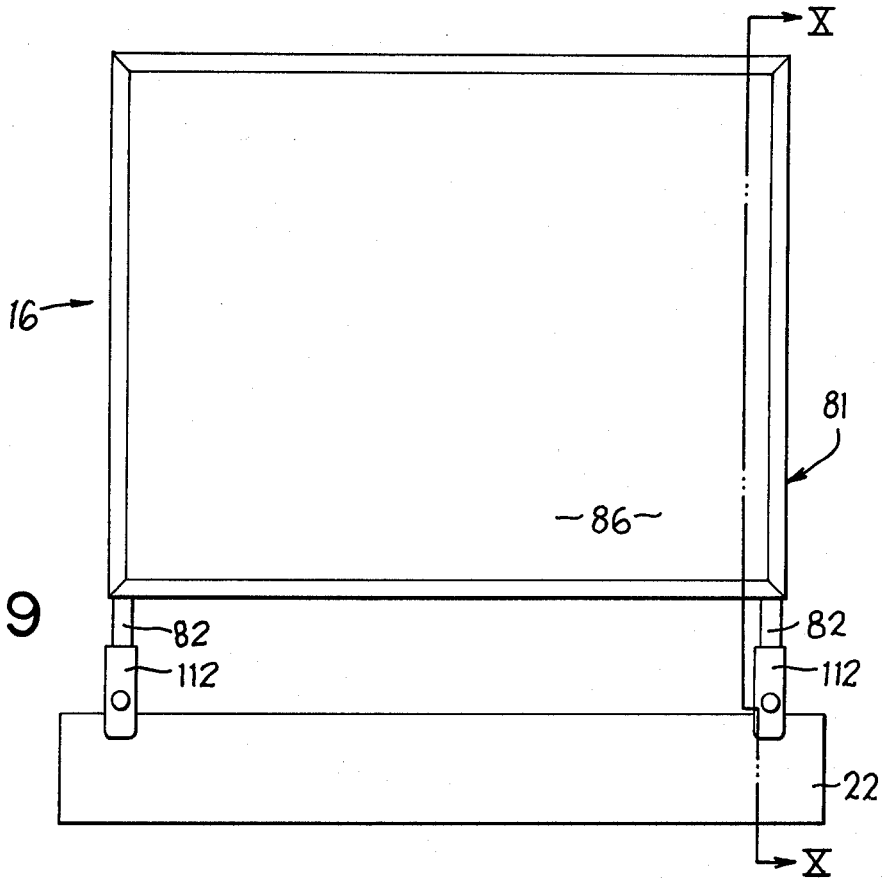
FIG. 9 is a front view showing the upright modesty panel assembly as mounted on a tier.
Figure 10:
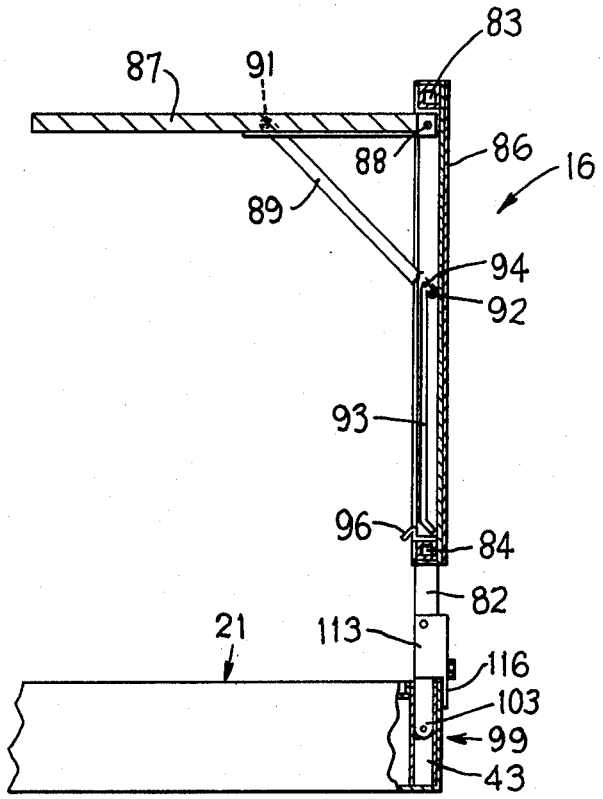
FIG. 10 is a fragmentary side elevational view, partially in cross section, illustrating the modesty panel and work surface of FIG. 9.

As illustrated by FIGS. 9 and 10, the panel assembly 16 includes a rigid frame 81 formed by a plurality of parallel side posts 82 which are rigidly joined together by a top rail 83 and a bottom rail 84, the latter being joined at a location located intermediate the free ends of the posts. The rectangular region defined by the posts 82 and the rails 83–84 is suitably covered by a thin planar modesty panel 86 which is fixedly secured to the front of the frame.

The panel assembly 16 also includes a planar work surface or panel 87, more conventionally known as a writing surface or desk. This desk 87 is designed to be disposed in a substantially horizontal use position as illustrated in FIG. 10, whereupon the desk 87 projects rearwardly from the modesty panel adjacent the upper portion thereof so as to permit use by an individual seated on a chair 17 as located on the respective tier.

The desk 87 is collapsible into a storage position wherein it stores within the region defined by the rectangular frame directly behind the modesty panel 86. For this purpose, the forward edge of the desk 87 is hinged at 88 to the adjacent posts 82. A pair of support arms 89 have the upper ends thereof hinged at 91 to the sides of the desk at a location spaced outwardly from the hinges 88. The other ends of arms 89 have hinge pins 92 thereon which are suitably hingedly and slidably supported within elongated guide grooves 93 as formed in rails which are secured to the inner surfaces of the posts 82. These guide grooves 93, at their upper ends are provided with notches 94 which project forwardly and downwardly so as to stationarily support the hinge pins 92 therein, whereupon the desk 87 can hence be securely supported in its raised or open position as illustrated by FIG. 10. However, by slightly lifting the desk 87 upwardly, this hence removes the hinge pins 92 from the notches 94, whereupon the hinge pins 92 then slide vertically downwardly along the guide grooves 93 to permit the desk 87 to be stored between the posts directly behind the modesty panel. A suitable detent, such as a spring clip 96 or the like, is preferably mounted on the lower rail 84 and creates a resilient engagement with the free edge of the desk 87 to thereby releasably hold the desk 87 in its closed position. This detent 96 exerts sufficient holding force on the lower edge of the desk to maintain same within the frame even when the latter is collapsed into a storage position wherein it is disposed so as to lay on the respective riser substantially as illustrated by FIG. 2.

Figure 2:
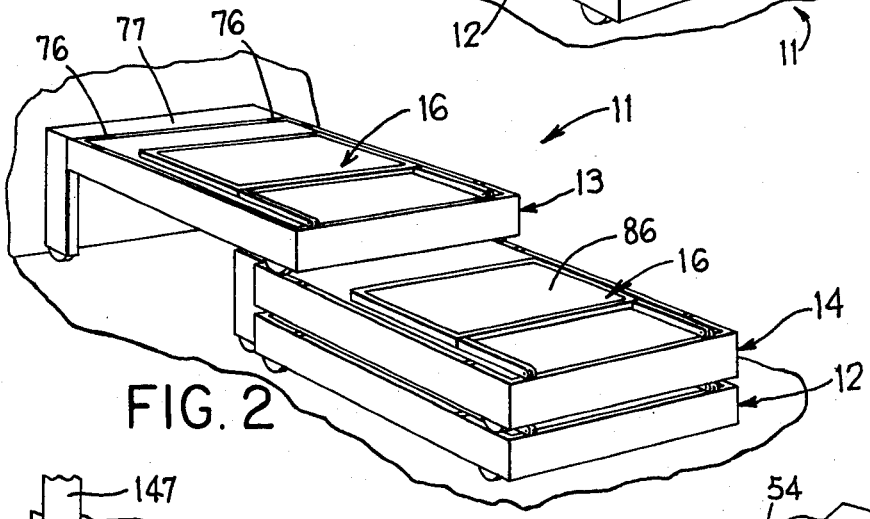
FIG. 2 is a perspective view of the improved riser module illustrated in a partially extended position.
Figure 4:
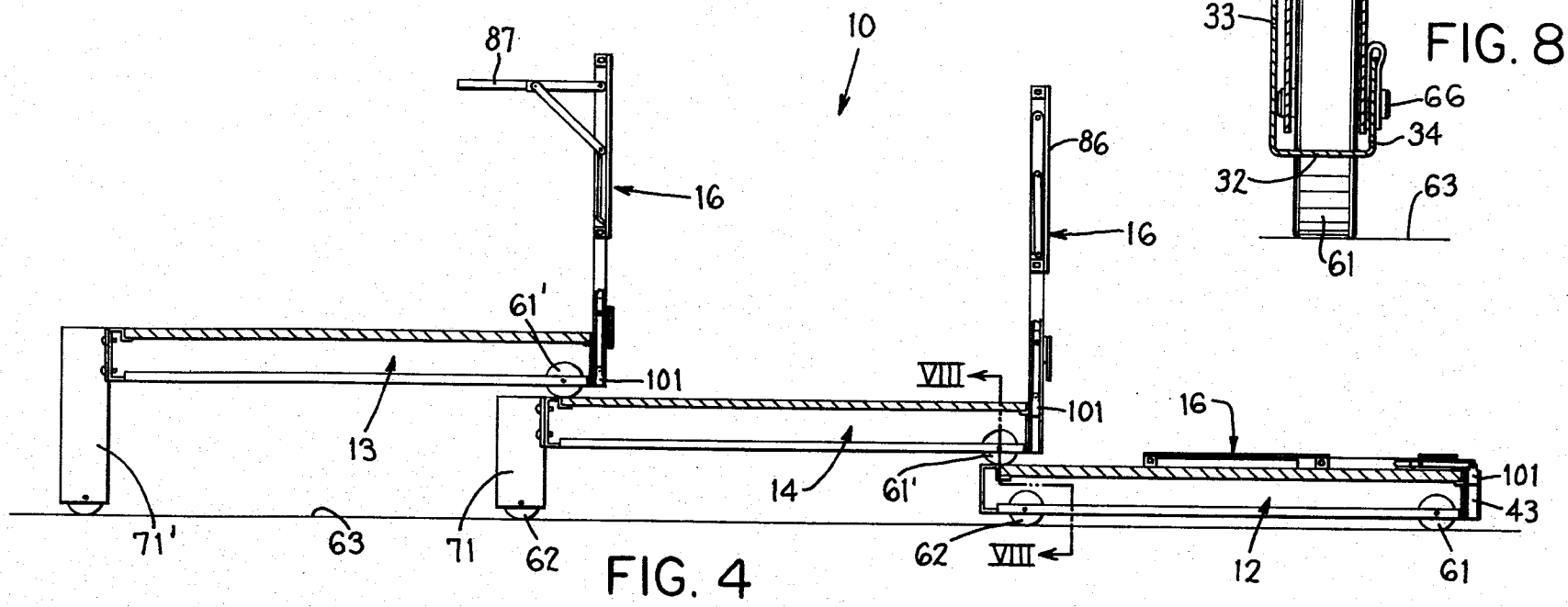
FIG. 4 is a side elevational view, partially in cross section, illustrating the riser module in its extended position, and illustrating the work surface-modesty panel assembly in various positions.
Figure 11:
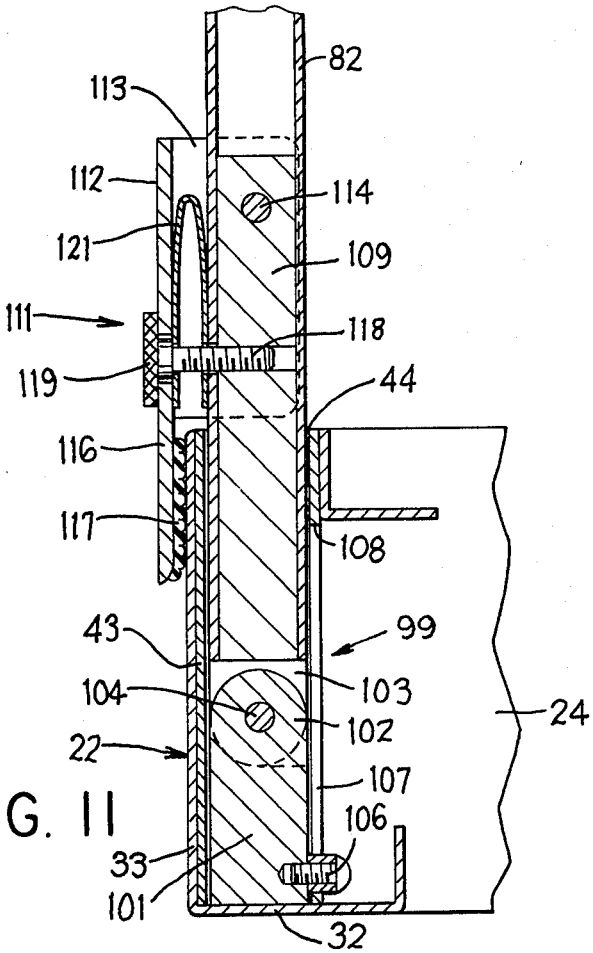
FIG. 11 is an enlarged, fragmentary sectional view illustrating the connection between the modesty panel post and the frame of the respective tier.

To permit the closed panel assembly 16 to be moved between the upright position shown on tier 14 of FIG. 2 and the storage or collapsed position shown on tier 12 of FIG. 4, there is provided a slidable hinge means 99 for connecting each post 82 to one of the front socket tubes 43. This slidable hinge means 99, as illustrated by FIG. 11, includes an elongated lower hinge member 101 which is vertically slidably supported within the socket tube 43. This hinge member 101 has a hinge knuckle 102 formed at the upper end thereof which fits between a pair of hinge parts 103 as defined at the lower ends of the opposed side walls of the post 82. These interfitting hinge parts 102 and 103 are hingedly connected by a hinge pin 104, whereby this resulting hinge hence can be totally confined but vertically slidably displaced within the socket tube 43.

The lower hinge member 101 has an appropriate stop screw 106 removably mounted thereon and projecting rearwardly therefrom through a vertically elongated guide slot 107 formed in the socket tube 43. The upper end of the slot 107 is limited by a shoulder 108 which contacts the stop screw 106 and normally limits the upward displacement of the hinge member 101 so as to prevent its accidental disengagement from the socket tube 43. However, when the hinge means 99 is lifted upwardly so that the stop 106 abuts the shoulder 108, then the hinge knuckle 102 is positioned so as to project upwardly above the upper surface of the front frame rail, thereby permitting the panel assembly 16 to be swingably displaced about the hinge axis 104 into a storage position wherein the panel assembly rests on the carpet 42.

The panel assembly 16 also includes clamping means 111 associated with each of the posts 82 so as to stationarily lock the panel assembly to the riser frame when the panel assembly is in the upright position illustrated by FIGS. 10 and 11. For this purpose, the clamping means 111 includes a channel-like clamp member 112 having parallel side walls 113 which straddle the post 82 at a region spaced upwardly from the bottom free end thereof. A hinge pin 114 extends between the post and the side legs 113 for hingedly connecting the clamp member 112 to the post. This hinge pin 114 also extends through the upper end of a reinforcing bar 109 which is fixedly positioned within the lower end of the post 82, which bar 109 provides additional strength particularly adjacent the upper end of the socket tube 43.

The clamp member 112 has a front wall 116 which projects downwardly beyond the side legs 113, whereby this front wall 116 overlaps the adjacent side wall 33 of the front rail 22. This lower portion of the front wall 16 has a high friction clamping pad 117 secured to the inner surface thereof, such as a pad of rubber or plastic material, whereby this pad 117 is adapted to frictionally clampingly engage the side wall 33. A clamping screw 118 having an enlarged manually engageable head 119 thereon extends through the front wall and is threadably engaged within the reinforcing bar 109 so that by manually tightening the screw 118 by rotation thereof, the friction pad 117 can be moved into snug frictional engagement with the frame side wall 33 to prevent or restrict accidental upward displacement of the panel assembly 16. A leaf spring 121 is preferably disposed between the clamp member 112 and the post 82 to bias the clamp member away from its normal clamping position, whereupon the clamping member will readily pass over the frame rail when the slidable hinge 99 is being lowered into the socket tube.

To permit adjacent modules 11 to be fixedly joined together, the modules are provided with side locking means 126 (FIGS. 12 and 13), which side locking means includes two parts, namely a male part 127 and a female part 128, which parts are disposed directly across from one another within the opposite ends of the front rail 22 so as to open outwardly through the opposite side rails 24. Hence, when two tiers are disposed side by side, the male part 127 on one tier is disposed directly opposite the female part 128 on the adjacent tier for locking engagement therewith.

Figure 12:
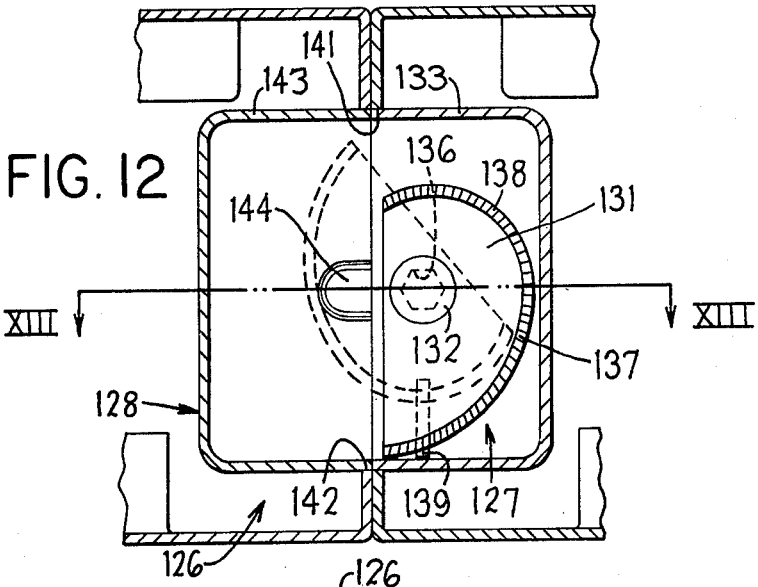
FIG. 12 is an enlarged, fragmentary sectional view showing the interlock between the tiers of adjacent modules.
Figure 13:
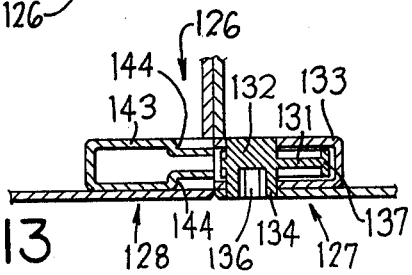
FIG. 13 is a fragmentary sectional view taken substantially along line XIII—XIII in FIG. 12.

As illustrated by FIGS. 12–13, the male part 127 includes an eccentric locking cam 131 which is rotatably supported by a hub 132 within a hollow housing 133, the latter being fixed within the front rail 22 so that the housing 133 opens outwardly through an opening 141 as formed in the side wall of the side rail 24. The hub 132 of the cam projects forwardly into an opening 134 as formed in the side wall of the front rail 22 so as to provide access to a tool-receiving recess 136 as formed in the hub, whereby a tool such as an Allen wrench can be engaged therewith so as to effect rotation of the cam.

The locking cam 131 has an eccentric rim 137 therearound, the end surfaces 138 of which are serrated so as to create a releasable detent-like engagement with inwardly projecting ribs 139 as formed on the opposed top and bottom walls of the housing 133.

The female locking part 128 includes a similar housing 143 which is fixed within the front rail 22 and opens outwardly through an appropriate opening 142 as formed in the side wall of the side rail 24. This female part defines therein, adjacent the free edge of the housing, a locking shoulder 144 which is defined by the formation of opposed depressions within the upper and lower walls of the housing 143. Hence, by rotating the cam 131 in a clockwise direction in FIG. 12, the eccentric cam swings into the housing 143 whereupon the eccentric rim 137 moves into snug camming relationship with the locking shoulders 144 to thereby tightly lock the side rails of adjacent tiers together. With this arrangement, an operator can easily lock or unlock the adjacent tiers merely by inserting an appropriate Allen wrench in to the recesses 136 so as to activate the eccentric cams. The locking means 126 are preferably provided on at least the front and rear tiers, and can also be provided on the intermediate tiers if desired.

As illustrated by FIG. 1, the handrail 18 is formed by individual units which removably mount on the individual tiers. Each of these handrail units includes a pair of parallel upright posts 146 and 147 which are rigidly joined together by a top rail 148 (which functions as a handrail) and a lower rail 149. These rails 148–149 are parallel, and extend at a slight slope which approximately corresponds with the average slope generated by the tiers when in an open position. The post 146 has an upper part 146*a* which is offset forwardly from the lower post part. The lower free ends of the posts 146–147 extend into and are snugly slidably supported within the side socket tubes 46.

The handrail units 18 also assist in locking the module 11 in its open position since, as shown in FIG. 5, each rear post 147 is positioned directly in front of the next upper tier to prevent relative closing movement between the tiers.

The rear handrail 19 is of similar construction in that it includes a pair of parallel upright posts 151 rigidly joined together by a horizontal top rail 152 and a horizontal bottom rail 153. The lower free ends of posts 151 extend into and are snugly slidably received within the rear socket tubes 76 as associated with the rear rail of the upper tier 13.

Figure 3:
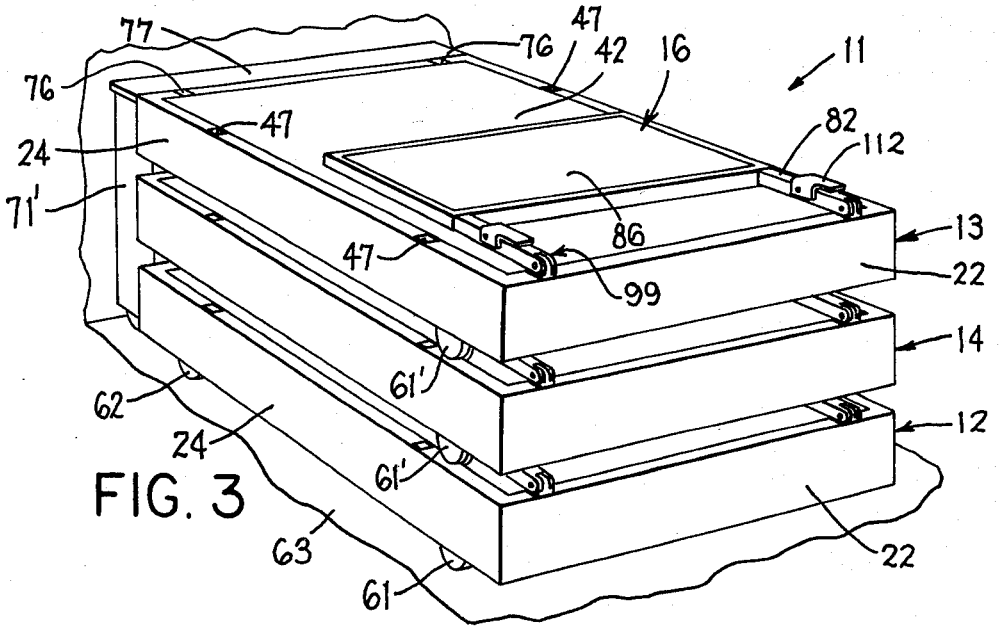
FIG. 3 is a perspective view illustrating the riser module in a fully closed position.

The riser module 11 is also provided with a releasable lock for connecting the tiers together in the closed position of FIG. 3 so as to permit the module to be moved about if desired. For this purpose, the rear frame rail of both the upper and lower tiers 12 and 13 are provided with a locking loop or hook 156 (FIGS. 5 and 6) projecting rearwardly therefrom. The hooks 156 on the upper and lower tiers are vertically aligned when the riser module is closed, and hence an elongated locking rod (not shown) can be slidably inserted downwardly through the aligned hooks to prevent accidental opening of the riser module. This locking rod is preferably of an L-shaped configuration and hence has a short horizontal leg at the upper end thereof which functions as a handle. Access to this rod is possible by removing or opening the cover panel 77.

With the riser assembly of this invention, the individual module 11 has a width which is substantially less than its length, and in fact the width of the module is approximately one-half its length. For example, in a preferred embodiment, the individual tiers have a width as measured between the side rails 24 of about 34 to 36 inches, whereas the length of the tiers as measured between the front and rear rails 22–23 is about 64 inches, although this length when measured from the front rail 22 to the rear of the legs 71 is about 70 inches. Further, the tier frames 21 have a height which is about 5 inches, with the vertical spacing between the vertically adjacent tier frames being about 2 inches, which spacing is hence just sufficient to accommodate the panel assemblies 16 when in the storage position so as to provide a very compact telescopic tiered arrangement. In fact, with these dimensions, a five-tier module hence has a height of only approximately 35 inches, which height thus approximately corresponds to the width of the module.

The width of the individual tiers is such that each tier will comfortably accommodate only a single chair thereon. However, it will be recognized that if small chairs are used, such as armless folding chairs, then two chairs could possibly be positioned side-by-side on each tier, although this must be considered as too crowded for occupant comfort. Alternately, it would be possible to position three small chairs on each adjacent pair of tiers, with the center chair straddling the abutting side rails of the adjacent tiers.

OPERATION

The use of the riser modules 11 according to the present invention is believed self-evident from the above description, although such use will be briefly described to insure a complete understanding thereof.

As above indicated, when the individual modules 11 are locked in the closed position illustrated by FIG. 3, then these individual modules 11 can be readily rollingly moved about as desired. For example, these modules can be rollingly moved through conventional doorways, and can even be readily moved onto and off of small elevators so as to permit their movement between floors.

The number of modules 11 which are positioned side by side is determined by the number of seats desired. For example, if it is desired to provide a tiered platform arrangement for seating thirty persons, then six five-tier modules or ten three-tier modules 11 are positioned in side-by-side relationship. After the rear locking rod is removed, then each individual module 11 is opened, such as by engaging the front rail of the front tier 12 with a suitable pulling tool, thereby causing the individual riser modules 11 to rollingly expand into the position illustrated by FIGS. 1 and 4. During this opening of the riser module, the front tier 12 rolls directly on the floor, whereas the front rollers 61′ of each other tier roll along the upper surfaces 41 of the side rails 24 associated with the next lowermost tier. Further, the rims 72 rollingly guide the rollers 61′ as they move along the side rails 24 so as to maintain proper alignment and rolling engagement between the vertically adjacent tiers. Alignment between the adjacent tiers is also maintained due to the engagement between the guide roller 54 on each lower tier and its engagement within the elongated guide channel 28 associated with the next uppermost tier. When each lower tier is fully extended relative to the next uppermost tier, this roller 54 abuts against the stop flange 29 of the next uppermost tier, thereby preventing any further relative movement therebetween so that further pulling on the front or lower tier hence results in a sequential opening of each tier until the module is fully expanded.

After all of the modules have been disposed in a side-by-side, fully expanded condition, then the side handrails 18 are slidably inserted into the socket tubes 46 associated with each tier along each free side edge of the thus-formed platform assembly. The rear handrails 19 are similarly mounted along the rear rails of the top tiers 14, although these latter handrails 19 can optionally be deleted if the overall assembly is disposed against a rear wall. Further, the side-by-side tiers of adjacent modules are also fixedly locked together by activating the locking means 126, such as by moving the locking cams 131 into the locked position illustrated by dotted lines in FIG. 12. With the adjacent tiers locked together by the locking means 126, and with the side handrails 18 mounted on each tier along both free side edges of the assembly, the overall assembly is hence rigidly joined together both in the sideward direction and in the front-to-back direction. The rigidity in this latter direction is achieved inasmuch as the rearmost post 147 of the handrail 18 is positioned so that it is disposed extremely close to the front rail of the next uppermost tier (as illustrated by FIG. 5) so as to prevent the two adjacent tiers from moving in a closing direction, whereas the engagement between the guide roller 54 and the stop flange 29 prevents the adjacent tiers from relatively moving in an opening direction.

After the plurality of modules 11 have been locked together so as to form the platform assembly 10 as described above, then the panel assemblies 16 are individually moved into their upright open position. For this purpose, with the panel assembly 16 in the storage position as illustrated by the front tier 12 of FIG. 4, the worker grasps the upper edge of the panel assembly 16 and hingedly swings same upwardly into an upright position, following which the complete hinge assembly 99 and the lower ends of the posts 82 can then be slid downwardly into the socket tubes 43 substantially as illustrated in FIG. 11. This thus maintains the panel assembly 16 in an upright condition, and then the locking screw 118 is manually rotated so that the clamping member 116 compresses its clamping pad 117 into snug frictional engagement with the exposed side wall 33 of the front rail 22. This thus securely holds the panel assembly 16 in the upright position illustrated by the intermediate tier 14 in FIG. 4, in which position the modesty panel 86 is operational although the work panel or desk 87 is in its closed position. If it is desired to additionally provide a work surface or desk, then the installer will manually grip the lower free edge of the desk 87 and swing same outwardly so as to release the detent, following which the desk is swung upwardly until the hinge pins 92 engage the notches 94 so as to thereby stationarily maintain the desk 87 in its position of use, substantially as illustrated on the top tier 13 in FIG. 4. A suitable chair 17 can then be positioned on the tier in cooperative relationship with the upright panel assembly 16.

At least one of the modules 11 will preferably be utilized for defining an aisle (as illustrated by the left module in FIG. 1), which aisle module can be disposed either at the edge of the assembly 10 or at an intermediate location. This aisle module is identical to the other modules except that the panel assemblies 16 are wholly removed therefrom. Normally at least one module of a group is not provided with panel assemblies so as to permit it to function as an aisle. However, any module can function as an aisle merely by removing the stop screw 106 associated with each hinge member 101, whereupon the entirety of the panel assembly 16 and hinge means 99 can thus be slidably displaced upwardly and wholly removed from the tier if desired. When so removed, only the top opening 44 remains, inasmuch as there are no upwardly projecting hinge parts or the like which would interfere with or create an obstruction to the free movement of people along the aisle. If desired, small removable plug-like caps can be positioned over the openings 44 associated with the aisle module.

If necessary, the rear module can be fixedly positioned relative to an adjacent wall, such as with releasable hooks or locks. Alternately, the modules can be provided with appropriate floor or wheel brakes, such as typically utilized on collapsible bleachers.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A telescopic multi-tier riser assembly, comprising:

a plurality of telescopic multi-tier riser modules positionable in side-by-side relationship to define an enlarged riser assembly;

each said riser module being of a telescopic multi-tier construction and indluding top and bottom platforms and at least one intermediate platform, said platforms being telescopically movable relative to one another between an open position wherein the individual platforms project forwardly in a step-like manner and a closed position wherein the platforms are vertically supported one above the other;

said platforms each having a side-to-side width which is substantially less than its front-to-back length, said width being such as to comfortably accommodate only a single chair on the respective platform;

a modesty panel assembly hingedly supported on each platform adjacent the forward edge thereof and swingably movable relative to the respective platform between an upright use position and a horizontal storage position wherein the modesty panel assembly is supported on the upper surface of the respective platform;

said platform including a pair of upwardly opening sockets formed therein adjacent the front edge thereof; and said modesty panel assembly having a pair of support posts which have the lower ends thereof connected to hinge means which are vertically slidably accommodated within said sockets for permitting the modesty panel assembly to be swingably moved between said upright and storage positions.

2. A riser assembly according to claim 1, wherein said modesty panel assembly includes enlarged planar work-surface means hingedly supported thereon and movable between (1) a use position wherein the work-surface means projects horizontally rearwardly from the modesty panel assembly when the latter is in its upright position and (2) a closed storage position wherein the work-surface means is located in substantially parallel relationship with and closely adjacent the rear of the modesty panel assembly.

3. A riser assembly according to claim 1, wherein said platforms have a pair of parallel horizontally elongated side rails which extend along the opposite side edges thereof, and wherein each of the intermediate and top platforms have a pair of front rollers mounted thereon and projecting downwardly therefrom in the vicinity of the front edge of the platform, said front rollers being rollingly supported on the side rails of the next lower platform, said front rollers having radially outwardly projecting annular flanges formed thereon for radially overlapping said side rails for maintaining said front rollers in rolling alignment and engagement with the side rails of the next lower platform when the platforms are relatively telescopically moved between open and closed positions.

4. A riser assembly according to claim 3, wherein said platform has a substantially planar floor panel extending between said side rails, said floor panel defining thereon an upper horizontal surface which is spaced downwardly a small distance from the upper surface of said side rails, and carpeting means positioned over said floor panel for filling the region between said side rails, said carpeting means having the upper surface thereof positioned approximately coplanar with the upper surfaces of said side rails.

5. A riser assembly according to claim 1, wherein each said platform has a maximum width of approximately 36 inches, and wherein said platform has a length which is approximately twice said width.

6. In a telescopic multi-tier unit having a plurality of vertically spaced platforms which are telescopically horizontally movable with respect to one another between an open position wherein the platforms define a step-like arrangement and a closed position wherein the platforms are supported vertically directly above one another, comprising the improvement wherein each platform mounts thereon modesty panel means, said modesty panel means including a pair of upright support posts and a vertically enlarged modesty panel fixedly secured therebetween, and connecting means for hingedly mounting said modesty panel means on the respective platform adjacent the forward end thereof for permitting the modesty panel means to be swingably moved between (1) a storage position wherein the modesty panel means is disposed horizontally and is supported on the floor of the platform and (2) an upright position wherein the modesty panel means projects substantially vertically upwardly from the floor in the vicinity of the forward edge of the respective platform, said connecting means including means for rigidly maintaining said modesty panel means in said upright position, said connecting means also including hinge means connected to the lower ends of said posts and being vertically slidably positioned within vertically elongated guide openings formed in said platform in the vicinity of the forward end thereof, said posts being insertable into said openings so as to position the sidable hinge means adjacent the lower ends of said openings to thereby rigidly maintain said modesty panel means in said upright position, said posts being upwardly slidable so as to withdraw same from said openings for causing said hinge means to project upwardly from said openings to permit the modesty panel assembly to be swingably folded down into said storage position.

7. A riser unit according to claim 6, including removable stop means associated with said hinge means for limiting the vertical displacement thereof relative to said platform to normally prevent said modesty panel assembly from being disconnected from the respective platform, said stop means being removable from said hinge means so as to enable said hinge means to be slidably lifted in its entirety out of said opening for totally disconnecting said modesty panel assembly from said platform, the upper surface of the floor of said platform being free of upwardly projecting obstructions when said hinge means are disconnected from the platform so that the platform can be utilized as an aisle.

8. A riser unit according to claim 6 or claim 7, including planar work-surface means movably mounted on said modesty panel means for movement between a use position wherein it projects horizontally rearwardly from the modesty panel means when the latter is in its upright position, and a non-use position wherein it is stored substantially parallel with and closely adjacent and directly behind the modesty panel means when the latter is in its upright position.

9. A riser unit according to claim 6, wherein said platform is of narrow width and has only a single modesty panel assembly mounted thereon, said riser width being sufficiently narrow so as to comfortably accommodate only a single chair thereon positioned behind said upright modesty panel means, said platform including a rigid rectangular frame which is defined by parallel front and rear frame rails which are rigidly joined together by parallel side frame rails, said frame supporting thereon a substantially planar floor which is supported on and extends between said frame rails, said frame having a small vertical height, and the frames of vertically adjacent platforms being spaced apart by a vertical distance which is substantially less then the vertical height of the individual frames so as to provide a minimum vertical clearance therebetween just sufficient to accommodate the modesty panel assemblies when the latter are in their storage positions.

10. In a telescopic multi-tier riser unit having a plurality of vertically spaced platforms which are relatively horizontally movable with respect to one another between an open position wherein the platforms define a step-like arrangement and a closed position wherein the platforms are all supported vertically directly above one another, comprising the improvement wherein each platform mounts thereon pairs of front and rear rollers for rollingly supporting same, the rollers of the lowermost platform being rollingly supported directly on the floor, each of the intermediate and top platforms having a pair of rear legs which are vertically elongated and project downwardly, said rear legs being provided with the rear rollers thereon so that the latter directly rollingly engage the floor, the pair of front rollers on each of said intermediate and top platforms being disposed in direct rolling engagement with upper guide surfaces formed directly on the next lowermost platform, said front rollers on said intermediate and top platforms having annular flanges projecting readially outwardly so as to overlap side surfaces on the next lower platform for maintaining adjacent platforms properly aligned as they are relatively horizontally moved between open and closed position, each platform including a pair of rigid side rails which define thereon the upwardly directed guide surfaces which are disposed in engagement with the flanged front rollers of the next platform, said side rails having horizontal support flanges fixed thereto and projecting inwardly therefrom, said horizontal support flanges being spaced downwardly from said guide surfaces, a sheet-like floor member supported on said horizontal flanges and extending between said side rails, said floor member defining thereon an enlarged horizontal upper surface which is spaced downwardly from said guide surfaces, and carpet means mounted on and overlying said floor member, said carpet means having the upper surface thereof disposed approximately coplanar with said guide surfaces, and the flanges on said front rollers projecting downwardly along the inner sides of said side rails into the region adjacent the edges of said carpet means.

11. A telescopic multi-tier riser assembly, comprising:

a plurality of telescopic multi-tier riser modules positionable in side-by-side relationship to define an enlarged riser assembly;

each said riser module being of a telescopic multi-tier construction and including top and bottom platforms and at least one intermediate platform, said platforms being telescopically movable relative to one another between an open position wherein the individual platforms project forwardly in a step-like manner and a closed position wherein the platforms are vertically supported one above the other;

said platforms each having a side-to-side width which is substantially less than its front-to-back length, said width being such as to comfortably accommodate only a single chair on the respective platform;

said platform having a pair of upwardly opening sockets formed therein adjacent each side edge thereof, said sockets of said pair being spaced from one another so as to be located more closely adjacent the front and rear ends of the respective platform;

a plurality of rigid handrail units mountable on the platforms of said module for creating a barrier along one side edge thereof, each said handrail unit being a rigid one-piece construction having a pair of downwardly projecting posts which project into said pair of sockets, the rearward post of said pair being positioned closely adjacent and passing directly in front of the front end of the next uppermost platform when said platforms are in said open position for preventing relative closing movement between said platforms; and each platform having an elongated guide channel fixed thereto and extending rearwardly thereof from the front to the back thereof, said guide channel being positioned substantially midway between the side edges of the platform and defining a downwardly opening guide groove, said guide channel defining a transverse stop adjacent the forward end thereof, and the lower and intermediate platforms each having guide roller means mounted thereon adjacent the rearward end of the platform and projecting upwardly therefrom for engagement within the guide channel of the next uppermost platform, said guide roller abutting said transverse stop when the adjacent platforms are in an open position for preventing further relative opening movement between the adjacent platforms.

12. A telescopic multi-tier riser assembly, comprising:

a plurality of telescopic multi-tier riser modules positionable in side-by-side relationship to define an enlarged riser assembly;

each said riser module being of a telescopic multi-tier construction and including top and bottom platforms and at least one intermediate platform, said platforms being telescopically movable relative to one another between an open position wherein the individual platforms project forwardly in a step-like manner and a closed position wherein the platforms are vertically supported one above the other;

said platforms each having a side-to-side width which is substantially less than its front-to-back length, said width being such as to comfortably accommodate only a single chair on the respective platform;

said platform including a horizontal frame which is substantially retangular and is defined by parallel side rails which are rigidly joined together by parallel front and rear rails, each of said intermediate and top platforms having a pair of rear support legs which are positioned rearwardly of but are fixedly attached to the rear rail of said frame, said rear support legs projecting vertically downwardly and being provided with rear support rollers on the lower ends thereof, said support rollers being disposed for direct rolling engagement with the floor, each of said intermediate and top platforms also having a pair of front rollers rotatably supported thereon adjacent the forward edge of the respective platform, said front rollers projecting downwardly from the frame and being disposed for direct rolling engagement with upper surfaces defined on the side rails of the next lowermost platform, the front rollers on said intermediate and top platforms having annular flanges which project radially outwardly thereof for overlapping a side surface on the respective side rail of the next lower platform for maintaining the vertically adjacent platforms properly aligned during the relative opening or closing movement therebetween; and the rails defining said frame having horizontal support flanges fixed thereto and projecting inwardly therefrom, said horizontal support flanges being spaced downwardly from the upper surfaces of the rails, a sheet-like floor member positioned between said rails and supported on said horizontal support flanges, said floor member defining thereon a horizontally enlarged planar upper surface which is spaced downwardly from the upper surfaces of said rails, and carpet means overlying said sheet-like floor member, said carpet means having the upper surface thereof disposed approximately coplanar with the upper surfaces of said rails, and the flanges on said front rollers projecting into the region defined between the inner surface of the respective side rail and the adjacent edge of said carpet means.

13. A riser assembly according to claim 12, wherein each of said platforms is provided with a pair of upwardly opening sockets formed in said front rail for permitting a modesty panel to be mounted in said sockets and project upwardly from the front of the respective platform, and each of said platforms also having a pair of upwardly opening sockets formed in each said side rail for permitting a handrail unit to be removably mounted therein so as to project upwardly adjacent the side of the respective platform.

14. A telescopic multi-tier riser assembly, comprising:

a plurality of telescopic multi-tier riser modules positionable in side-by-side relationship to define an enlarged riser assembly;

each said riser module being of a telescopic multi-tier construction and including top and bottom platforms and at least one intermediate platform, said platforms being telescopically movable relative to one another between an open position wherein the individual platforms project forwardly in a step-like manner and a closed position wherein the platforms are vertically supported one above the other;

said platforms of each module having a side-to-side width which is substantially less than its front-to-back length, said width being such as to comfortably accommodate only a single chair on the respective platform;

each said platform including a rigid rectangular frame defined by parallel front and rear frame rails rigidly joined together by parallel side frame rails, said frame having a small vertical height, and the frames of vertically adjacent platforms being spaced apart by a vertical distance which is substantially less than the vertical height of the individual frames to provide a minimum vertical clearance between adjacent platforms;

each of said intermediate and top platforms having a pair of rear support legs which are attached to the rear of said frame, said rear support legs projecting vertically downwardly and being provided with rear support rollers on the lower ends thereof which are disposed for direct rolling engagement with the floor;

each of said intermediate and top platforms also having a pair of front rollers rotatably supported thereon adjacent the forward edge of the respective platform, said front rollers being disposed adjacent the opposite sides of the respective platform and projecting downwardly from the frame thereof so as to be disposed for direct rolling engagement with upper surfaces defined on the side rails of the next lowermost platform, the front rollers on said intermediate and top platforms having annular flanges which project radially outwardly thereof for overlapping a side surface on the respective side rail of the next lowermost platform for maintaining the vertically adjacent platforms properly aligned during the relative opening or closing movement therebetween; and said rectangular frame having a floor structure supported on the rails and extending horizontally across the interior of the frame, said floor structure defining thereon a horizontally enlarged upper surface disposed approximately coplanar with the upper surfaces of said rails.

15. A riser assembly according to claim 14, including manually actuatable lock means mounted on and coacting between selected platforms of adjacent modules for fixedly sidewardly connecting the adjacent modules together, said lock means including a movable locking part mounted on the selected platform of each module adjacent one side thereof and a cooperating lock part mounted on the selected platform of each module adjacent the other side therof, said movable lock part on one module being manually actuated for locking engagement with the cooperating lock part on the sidewardly adjacent module.

16. A riser assembly according to claim 15, wherein said lock means is mounted on at least the top and bottom platforms of each said module, and said lock means being manually accessible from the top or front side of the module.

17. A riser unit according to claim 14, including a modesty panel assembly supported on each platform adjacent the forward edge thereof and movable relative to the respective platform between an upright use position and a horizontal storage position wherein the modesty panel assembly is supported on the upper surface of the respective platform, said modesty panel assembly including an enlarged modesty panel secured to elongated post means which is mounted on and projects upwardly from the platform adjacent the forward edge thereof when the modesty panel assembly is in its upright use position.

18. A riser assembly according to claim 14, wherein said side rails are formed by wall means which define a substantially tubular cross section, said front rollers being rotatably supported on and positioned within said tubular wall means so that the roller projects downwardly through an opening formed in a lower wall of said tubular wall means so as to be positioned for rolling engagement with the upper surface of the side rail on the next lowermost platform.

19. A riser assembly according to claim 14, wherein said modules are identical and each has a maximum width of about 36 inches and a length which is about twice the width.

20. A telescopic multi-tier riser assembly, comprising:

a plurality of identical, portable, telescopic, multi-tier riser modules positionable in direct side-by-side relationship to define an enlarged riser assembly;

each said riser module being of a telescopic multi-tier construction and including top and bottom platforms and at least one intermediate platform, said platforms being telescopically movable relative to one another between an open position wherein the individual platforms project forwardly in a step-like manner and a closed position wherein the platforms are vertically supported one above the other;

said platforms each having a side-to-side width which is approximately one-half its front-to-back length, said width being a maximum of about 36 inches so as to comfortably accommodate only a single chair on the respective platform;

each said platform including a rigid rectangular frame having parallel side rails, said frame having a small vertical height, the frames of vertically adjacent platforms being spaced apart by a vertical distance which is substantially less than the vertical height of the individual frames to provide a minimum vertical clearance between adjacent platforms;

said bottom platform having pairs of front and rear rollers rotatably supported thereon adjacent the respective front and rear edges thereof and disposed for direct rolling engagement with the floor, the rollers on said bottom platform permitting the respective riser module to be readily rollingly moved about when in a closed position;

each of said intermediate and top platforms having a pair of rear support legs which are attached to the rear of said frame, said rear support legs projecting downwardly and being provided with rear support rollers adjacent the lower ends thereof which are disposed for direct rolling engagement with the floor;

each of said intermediate and top platforms also having a pair of front rollers rotatably supported thereon adjacent the forward edge of the respective platform, said front rollers being disposed adjacent the opposite sides of the respective platform and projecting downwardly from the frame so as to be disposed for direct rolling engagement with upper surfaces defined on the side rails of the next lowermost platform; and releasable lock means mounted on and coacting between selected platforms of adjacent modules for fixedly sidewardly connecting the adjacent modules together, said lock means including a movable locking part associated with the selected platform of each module adjacent one side thereof and a cooperating lock part associated with the selected platform of each module adjacent the other side thereof, said movable lock part on one module being lockingly engageable with the cooperating lock part on the sidewardly adjacent module.

21. A riser assembly according to claim 20, including means associated with both sides of some of the platforms of each riser module for permitting removable hand rail means to be selectively mounted on and extend along either or both sides of the riser module when in its open position.

* * * * *

UNITED STATES PATENT AND TRADEMARK OFFICE

CERTIFICATE OF CORRECTION

PATENT NO. : 4 467 569

DATED : August 28, 1984

INVENTOR(S) : Russell O. Blanchard et al

It is certified that error appears in the above-identified patent and that said Letters Patent is hereby corrected as shown below:

Column 12, line 9; change "indluding" to ---including---.

Column 13, line 7; after "multi-tier" insert ---riser---.

Column 13, line 34; change "sidable" to ---slidable---.

Column 14, line 33; change "readially" to ---radially---.

Column 14, line 37; change "position" to ---positions---.

Column 17, line 31; change "therof" to ---thereof---.

Signed and Sealed this

*Fifth* Day of *March 1985*

[SEAL]

*Attest:*

DONALD J. QUIGG

*Attesting Officer* *Acting Commissioner of Patents and Trademarks*